US009383700B2

(12) United States Patent
Tani et al.

(10) Patent No.: US 9,383,700 B2
(45) Date of Patent: Jul. 5, 2016

(54) IMAGE FORMING APPARATUS

(71) Applicant: CANON KABUSHIKI KAISHA, Tokyo (JP)

(72) Inventors: Nobuhiro Tani, Matsudo (JP); Tomoharu Kitajima, Toride (JP); Tadashi Fukuda, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/672,051

(22) Filed: Mar. 27, 2015

(65) Prior Publication Data

US 2015/0277320 A1 Oct. 1, 2015

(30) Foreign Application Priority Data

Mar. 31, 2014 (JP) ..... 2014-074930

(51) Int. Cl.
*G03G 15/01* (2006.01)
*G03G 15/00* (2006.01)
*G03G 15/08* (2006.01)

(52) U.S. Cl.
CPC ..... *G03G 15/50* (2013.01); *G03G 15/01* (2013.01); *G03G 15/0824* (2013.01); *G03G 15/0827* (2013.01); *G03G 15/5033* (2013.01); *G03G 2215/00042* (2013.01)

(58) Field of Classification Search
CPC ..... G03G 15/08
USPC ..... 399/74
See application file for complete search history.

(56) References Cited

U.S. PATENT DOCUMENTS

| | | | | |
|---|---|---|---|---|
| 6,321,044 | B1 * | 11/2001 | Tanaka | 399/49 |
| 2011/0026953 | A1 | 2/2011 | Tomita | |
| 2013/0004189 | A1 * | 1/2013 | Hashiguchi et al. | 399/49 |
| 2014/0064770 | A1 * | 3/2014 | Yanata | 399/74 |
| 2014/0147153 | A1 * | 5/2014 | Murayama | 399/74 |
| 2014/0294420 | A1 * | 10/2014 | Lee | 399/74 |

FOREIGN PATENT DOCUMENTS

| | | | | |
|---|---|---|---|---|
| JP | 5-181363 | A | 7/1993 | |
| JP | 2002-131997 | * | 5/2002 | G03G 15/00 |
| JP | 2002-131997 | A | 5/2002 | |
| JP | 2007-298782 | * | 11/2007 | G03G 15/08 |
| JP | 2007-298782 | A | 11/2007 | |
| JP | 4724288 | B2 | 4/2011 | |

OTHER PUBLICATIONS

U.S. Appl. No. 14/667,084, filed Mar. 24, 2015.

* cited by examiner

*Primary Examiner* — Clayton E LaBalle
*Assistant Examiner* — Kevin Butler
(74) *Attorney, Agent, or Firm* — Canon USA, Inc. I.P. Division

(57) ABSTRACT

An image forming apparatus including a movable image bearing member, a sensor arranged so as to oppose the image bearing member, a shutter member movable between an opened position and a closed position, a vibration mechanism configured to apply vibration to the shutter member, and an executing portion configured to execute a vibrating action which applies vibrations to the shutter member by the vibration device based on image formation history information.

11 Claims, 13 Drawing Sheets

IMAGE FORMING APPARATUS

BACKGROUND OF THE INVENTION

1. Field of the Invention

This disclosure relates to an image forming apparatus provided with a sensor configured to detect a state of an object to be detected on an image bearing member such as a photosensitive member, an intermediate transfer member, and a transfer material bearing member.

2. Description of the Related Art

In the related art, an image forming apparatus using an electrophotographic process, a reference image formed on an image bearing member is read by a sensor as a detection device, an amount of misalignment from a reference obtained from a read result is calculated, and an amount of color-registration and an image density are corrected and maintained to adequate values. In this case, an optical sensor is used as the sensor. Examples of the image bearing member includes a photosensitive member, an intermediate transfer member, and a transfer material bearing member.

For example, in the case of a tandem-type image forming apparatus in which an intermediate transfer system is employed, reference images for a correction of color-registration in respective colors are formed on the intermediate transfer member by image forming units of respective colors, and positions of the reference images in the respective colors are detected by the sensor, whereby the correction of the color-registration is performed. In the image forming apparatus as described above, reference images for a correction of density in respective colors are formed on the intermediate transfer member by the image forming units of the respective colors, the density of the reference images of the respective colors are detected by the sensor, whereby the correction of density in the respective colors is performed.

Here, as one of causes which deteriorate detection accuracy of the sensor as described above, flapping of the reference images, which are objects to be detected is exemplified. For example, the intermediate transfer member of an endless belt shape is flapped in a depth direction of the sensor, the result of detection of the reference image varies. In order to avoid such a problem, a roller may be arranged at a position opposing a sensor on an inner peripheral surface side of the intermediate transfer member to restrain the flapping of the intermediate transfer member. However, when images (output images or reference images) transferred to a surface of the intermediate transfer member pass through a position on the roller having a potential difference with respect thereto, toner may fly around from the surface of the intermediate transfer member. As a result, the toner may fly toward a detection surface of the sensor arranged in proximity to the intermediate transfer member, and the flown toner may be adhered to the detection surface of the sensor.

As described in Japanese Patent No. 4724288, an openable-and-closable shutter member (protecting member) may be provided between the sensor and the intermediate transfer member.

SUMMARY OF THE INVENTION

An image forming apparatus of this disclosure includes: a movable image bearing member configured to bear a toner image a sensor arranged so as to oppose the image bearing member a shutter member arranged between the sensor and the image bearing member and being movable between an opened position at which the sensor is exposed to the image bearing member and a closed position at which the sensor is blocked with respect to the image bearing member, a vibration mechanism configured to apply vibrations to the shutter member, and an executing portion configured to execute a vibrating action which applies vibrations in the shutter member by the vibration mechanism based on image formation history information.

Further features of the present invention will become apparent from the following description of exemplary embodiments with reference to the attached drawings.

DESCRIPTION OF THE EMBODIMENTS

An image forming apparatus of this disclosure will be described below further in detail with reference to the drawings.

Example 1

1. General Configuration and Actions of Image Forming Apparatus

Figure 1:
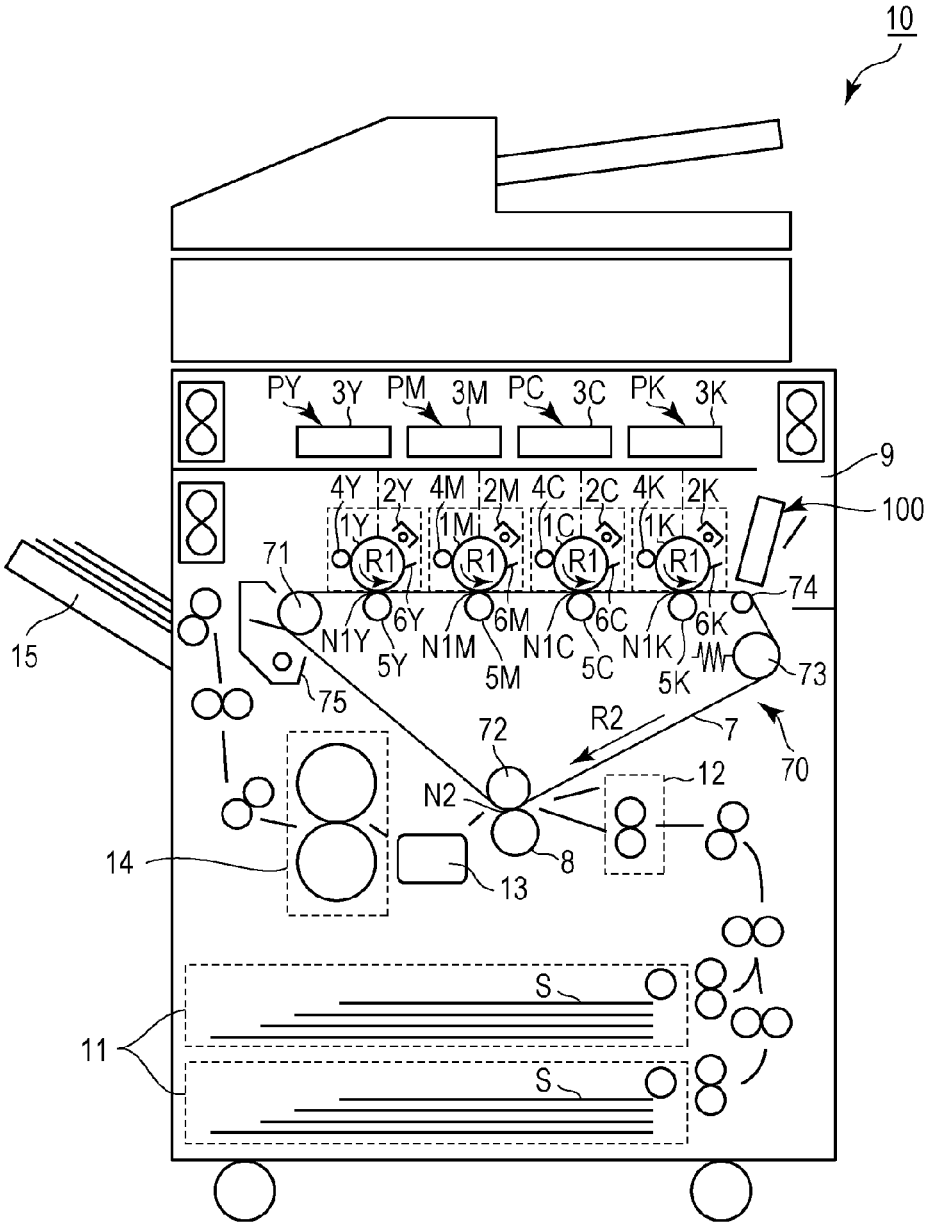
FIG. 1 is a schematic cross-sectional view of an image forming apparatus.

FIG. 1 illustrates a schematic cross-sectional view of an image forming apparatus of an embodiment of this disclosure. An image forming apparatus 10 of this example is a tandem-type color copying machine employing an intermediate transfer system capable of forming full-color images by utilizing an electrophotographic system.

The image forming apparatus 10 includes a first, second, third and fourth image forming units (stations) PY, PM, PC, and PK configured to form an image in yellow (Y), magenta (M), cyan (C), and black (K), respectively, as a plurality of image forming units. In this example, configurations and actions of the respective image forming units PY, PM, PC, and PK are substantially the same except for difference in color of toner to be used. Therefore, in the case where discrimination is not specifically required, suffixes of reference numerals, Y, M, C, and K, which indicate that the corresponding element relates to any one of these colors, are omitted, and these elements are described as a whole. In the following description, the near side of the paper plane of FIG. 1 is determined as a front (front face) side of the image forming apparatus 10, and the far side of the paper plane of FIG. 1 is determined as an inner (back) side of the image forming apparatus 10. The left side and the right side when the image forming apparatus 10 is viewed from the front side are determined to be the left side and the right side of the image forming apparatus 10. A depth direction connecting the front side and the inner side of the image forming apparatus 10 is assumed to be substantially parallel to a direction of a rotational axis of a photosensitive drum 1, which will be descried later.

The photosensitive drum 1, which is a drum-shaped (cylindrical) electrophotographic photosensitive member (photosensitive member), as an image bearing member is arranged on an image forming unit P. The photosensitive drum 1 is driven to rotate in a direction indicated by an arrow R1 in the drawing by a drive motor (not illustrated) as a driving device. Respective devices described below are arranged around the photosensitive drum 1 along a direction of rotation thereof. First of all, a charger 2 as a charging device is arranged. An exposing unit (laser scanner unit) 3 as an exposure device is arranged. Subsequently, a developing unit 4 as a developing device is arranged. Subsequently, a primary transfer roller 5, which is a roller-type primary transfer member as a primary transfer device is arranged. Subsequently, a drum cleaner 6 as a photosensitive member cleaning device is arranged.

The rotating photosensitive drum 1 is evenly charged by the charger 2. A surface of the charged photosensitive drum 1 is scanned and exposed by the exposing unit 3, so that an electrostatic latent image (electrostatic image) is formed on the photosensitive drum 1. The electrostatic latent image formed on the photosensitive drum 1 is developed by the developing unit 4 by using toner as a developer.

The exposing unit 3 is provided with a laser whereof light emission is controlled in accordance with an image signal, and a plurality of mirror portions configured to guide a laser beam onto the photosensitive drum 1. By adjusting timing of light emission or a mirror of the laser, timing of writing the image can be adjusted, so that a writing position of each color can be adjusted. Also, by adjusting a potential of the photosensitive drum 1 and an amount of the laser beam, an image density can be adjusted.

In contrast, in a mode of penetrating horizontally through the respective image forming units PY, PM, PC, and PK, an intermediate transfer belt 7 as an endless belt type intermediate transfer member is arranged below respective photosensitive drums 1Y, 1M, 1C, and 1K. The intermediate transfer belt 7 is an example of a movable image bearing member. The intermediate transfer belt 7 is wound around a drive roller 71, a secondary transfer opposed roller 72, a tension roller 73, and a backup roller 74 as a plurality of supporting rollers (tension rollers) under a tension. The intermediate transfer belt 7 rotates (orbits) in a direction indicated by an arrow R2 by an input of a drive force to the drive roller 71 from the drive motor (not illustrated) as a driving device. The intermediate transfer belt 7 is wound around the plurality of supporting rollers in a state of being under a predetermined tension applied thereto by the tension roller 73 being biased from an inner peripheral surface side to an outer peripheral surface side. The respective primary transfer rollers 5 are arranged on the inner peripheral surface side of the intermediate transfer belt 7 at positions opposing the respective photosensitive drums 1. The primary transfer rollers 5 are biased (pressed) toward the photosensitive drums 1 via the intermediate transfer belt 7, and primary transfer portions (primary transfer nip portions) N1 where the intermediate transfer belt 7 and the photosensitive drums 1 are in contact with each other are formed. On the outer peripheral surface side of the intermediate transfer belt 7 at a position opposing the secondary transfer opposed roller 72, a secondary transfer roller 8 as a roller-type secondary transfer member is arranged as a secondary transfer device. The secondary transfer roller 8 is biased (pressed) toward the secondary transfer opposed roller 72 via the intermediate transfer belt 7, and a secondary transfer portion (secondary transfer nip portion) N2 where the intermediate transfer belt 7 and the secondary transfer roller 8 are in contact with each other is formed. On the outer peripheral surface side of the intermediate transfer belt 7 at a position opposing the drive roller 71, a belt cleaner 75 as an intermediate transfer member cleaning device is arranged. The intermediate transfer belt 7, the supporting rollers 71, 72, 73, and 74 and the belt cleaner 75 of the intermediate transfer belt 7 constitute part of an intermediate transfer belt unit 70.

A toner image formed on the photosensitive drum 1 is transferred (primary transfer) to the intermediate transfer belt 7 by an action of the primary transfer roller 5 to which a primary transfer voltage (primary transfer bias) is applied at the primary transfer portion N1. For example, when forming a full-color image, the toner images of the respective colors are transferred onto the intermediate transfer belt 7 at first, second, third, and fourth image forming units PY, PM, PC, and PK so as to be overlapped one on top of another in sequence. The toner images transferred to the intermediate transfer belt 7 are transferred (secondary transfer) to a transfer material (sheet material) S such as a recording sheet by an action of the secondary transfer roller 8 to which a secondary transfer voltage (secondary transfer bias) is applied at the secondary transfer portion N2. For example, when forming a full-color image, the toner images in four colors overlapped on the intermediate transfer belt 7 are transferred to the transfer material S at once. The transfer material S is fed from a storage 11 of a transfer material supply unit, is adjusted in posture by a registration adjusting unit 12, and then is conveyed to the secondary transfer portion N2.

The transfer material S on which the toner images are transferred is conveyed by being born on a conveying belt 13, which is an endless belt-shaped conveyance member. The conveying belt 13 is driven by the drive motor (not illustrated) as a driving device. On the inner peripheral surface side of the conveying belt 13, a suction fan (not illustrated) is arranged for absorbing the transfer material S, whereby the transfer material S is absorbed to the conveying belt 13. Subsequently, the transfer material S is conveyed to a fixing apparatus 14 as a fixing device arranged downstream of the conveying belt 13 in the direction of conveyance thereof. The transfer material S is heated and pressurized by the fixing apparatus 14 so that the toner image is fixed thereon. Accordingly, an image is obtained on the transfer material S. Subsequently, the transfer material S is conveyed to a transfer material discharging portion, and is discharged on a transfer member discharge tray 15 outside of an apparatus body 9 of the image forming apparatus 10 (outside of the apparatus).

Adhered substances remaining on the photosensitive drum 1 after the primary transfer such as toner (primary transfer remaining toner) is removed from the photosensitive drum 1 by the drum cleaner 6 and is collected. Adhered substances remaining on the intermediate transfer belt 7 after the secondary transfer such as toner (secondary transfer remaining toner) is removed from the intermediate transfer belt 7 by the belt cleaner 75 and is collected.

The image forming apparatus 10 includes a sensor unit 100 on the downstream of a downstream most primary transfer portion N1K in the direction of conveyance of the transfer material S arranged so as to oppose the outer peripheral surface of the intermediate transfer belt 7 on the upstream of the secondary transfer portion N2. The sensor unit 100 includes a registration sensor 102 (FIG. 5) and a density sensor 103 (FIG. 6), which are optical sensors, as sensors arranged so as to oppose the image bearing member, which corresponds to the intermediate transfer belt 7, for detecting the state of the object to be detected on the image bearing member. The backup roller 74 is arranged on the inner peripheral surface side of the intermediate transfer belt 7 at a position opposing the sensor unit 100. The sensor unit 100 will be described further in detail later.

Figure 2:
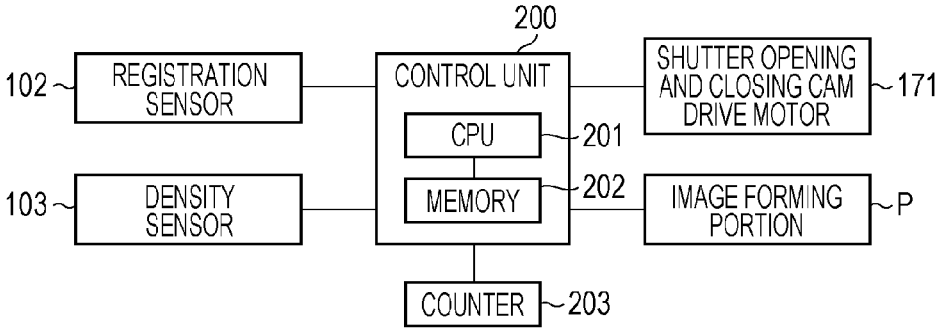
FIG. 2 is a schematic control block diagram of a principal portion of the image forming apparatus.

FIG. 2 illustrates a schematic control mode of a principal portion of the image forming apparatus 10 in this example. A control unit 200 as a control device provided on the image forming apparatus 10 includes a CPU 201, which is a central element that performs arithmetic operation, and a memory 202 such as a ROM and a RAM as a memory device. Results of detection of the sensors and results of arithmetic operation are stored in the RAM, and a control program, and data tables obtained in advance are stored in the ROM. In this example, the control unit 200 controls the respective portions of the image forming apparatus 10 as a whole. In the relationship with this example, the control unit 200 corrects the action of the image forming unit P on the basis of the results of detection of the registration sensor 102 and the density sensor 103, and executes control of an adjustment of the writing positions of the respective colors and an adjustment of the image density. The control unit 200 executes control of driving of a shutter opening and closing cam drive motor 171 of the sensor unit 100, although detail description will be given later. A counter 203 configured to accumulate and store the accumulated number of formed images as the image formation history information used for controlling the drive of the shutter opening and closing cam drive motor 171 is connected to the control unit 200.

2. Sensor Unit

Figure 3:
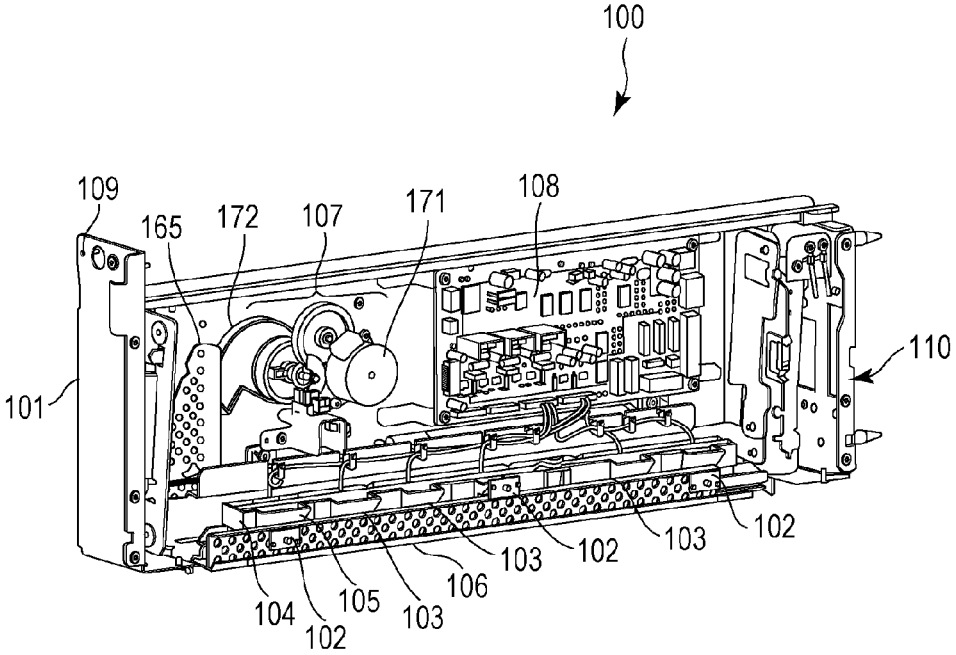
FIG. 3 is a perspective view illustrating an interior of a sensor unit.
Figure 4:
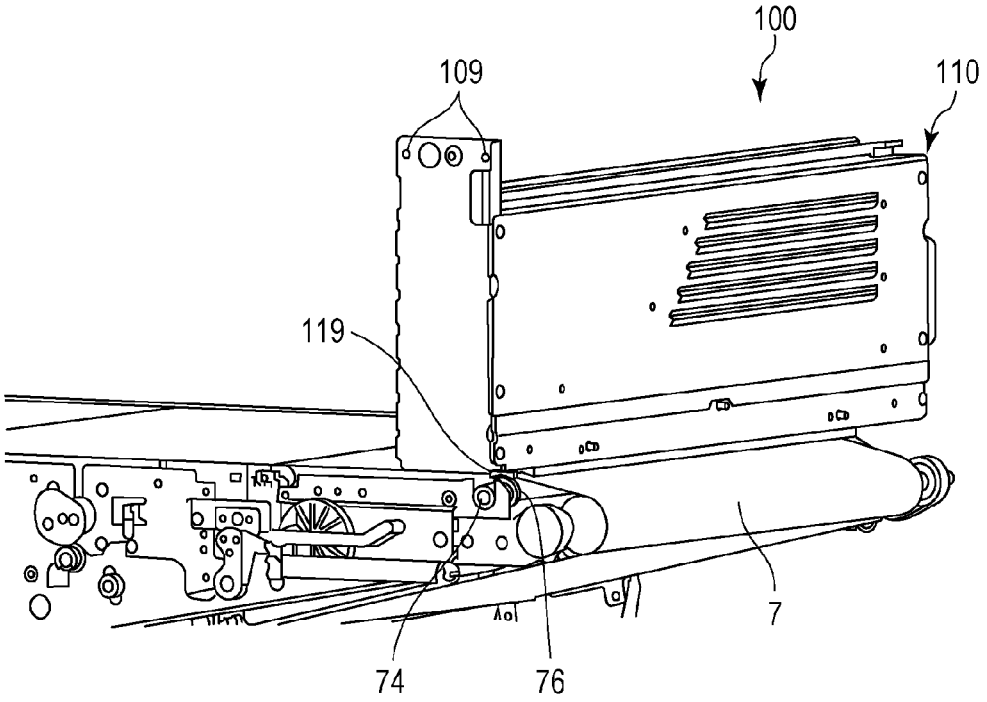
FIG. 4 is a perspective view of a portion in the vicinity of a mounting portion of the sensor unit.
Figure 5:
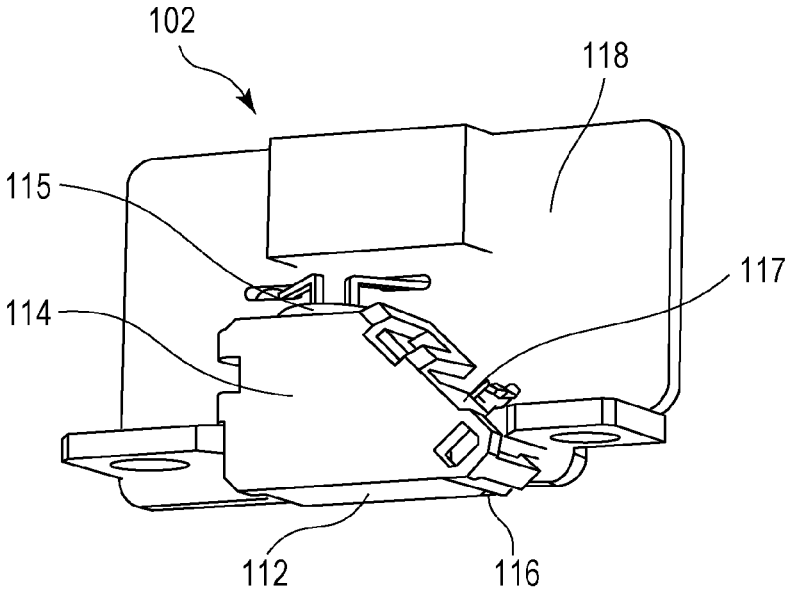
FIG. 5 is a perspective view of a registration sensor.
Figure 6:
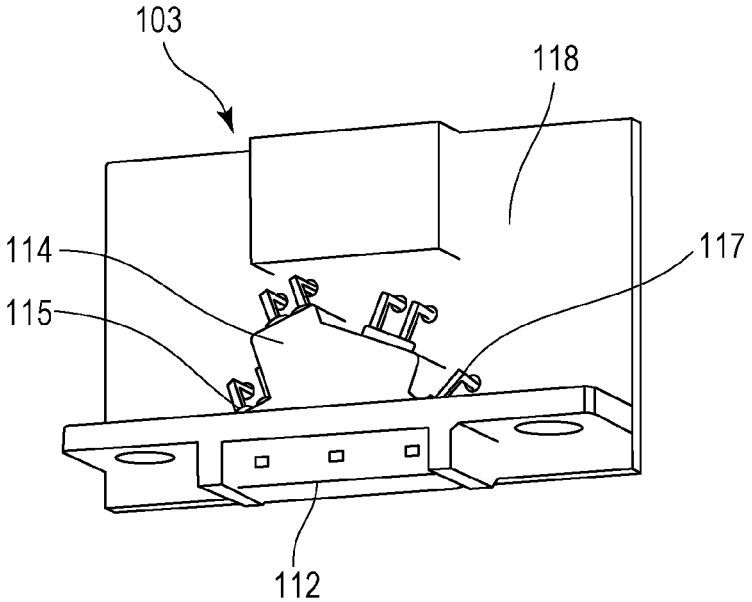
FIG. 6 is a perspective view of a density sensor.
Figure 7:
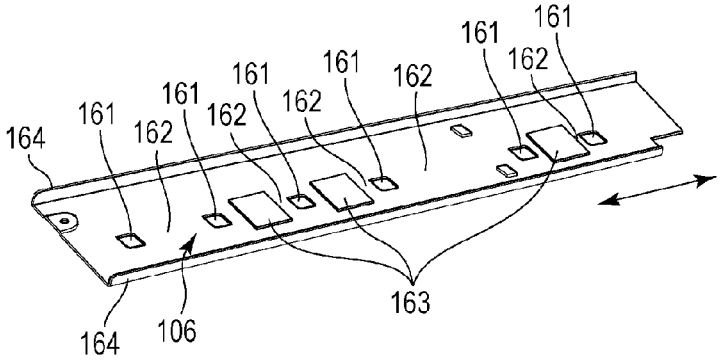
FIG. 7 is perspective view of a shutter member provided on the sensor unit.
Figure 8:
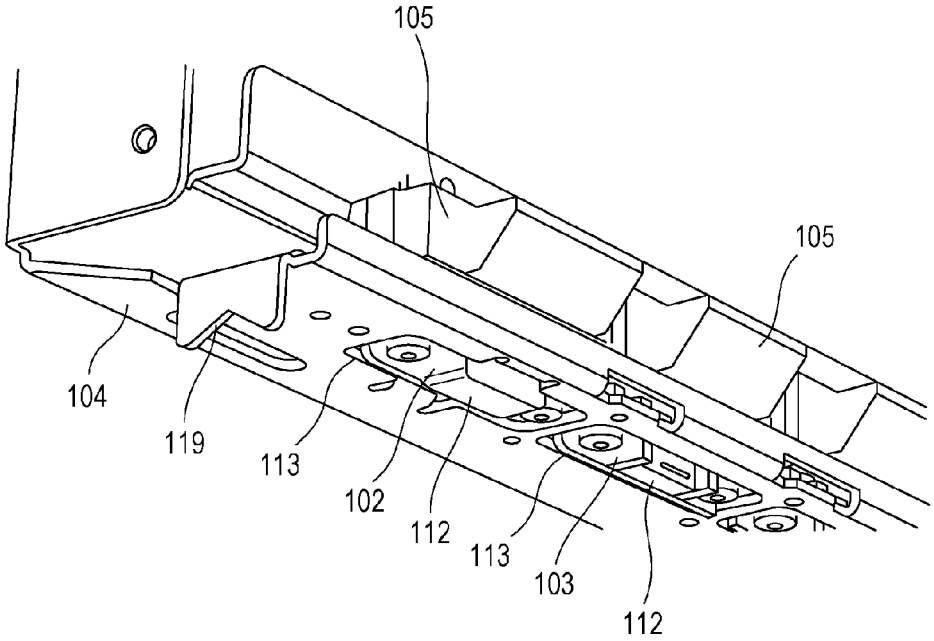
FIG. 8 is a perspective view of the sensor unit viewed from a detection surface side of the sensor.

A general configuration and an action of the sensor unit 100 of this example will be described. FIG. 3 is a perspective view of the interior of the sensor unit 100 viewed from the right side of the image forming apparatus 10. FIG. 4 is a perspective view of a portion in the vicinity of a mounting portion of the sensor unit 100. FIG. 5 is a perspective view of the registration sensor 102. FIG. 6 is a perspective view of the density sensor 103. FIG. 7 is a perspective view of a shutter member 106 provided on the sensor unit 100. FIG. 8 is a perspective view of the registration sensor 102 and the density sensor 103 mounted on the sensor unit 100 viewed from a detection surface 112 side.

As illustrated in FIG. 3, the sensor unit 100 of this example includes elements as follows as principal components. First of all, the sensor unit 100 includes a frame 101 as a base of the sensor unit 100. The sensor unit 100 includes the registration sensors 102 as an optical sensor, for reading the reference image for the correction of color-registration (color-correction patch), which is a toner image formed on the intermediate transfer belt 7. The sensor unit 100 includes the density sensors 103 as an optical sensor, for reading the reference image for the correction of density (density correction patch), which is a toner image formed on the intermediate transfer belt 7. The sensor unit 100 includes a sensor supporting plate 104 on which the registration sensors 102 and the density sensors 103 are mounted. The frame 101 and the sensor supporting plate 104 constitute a housing 110 configured to accommodate the registration sensors 102 and the density sensors 103. The sensor supporting plate 104 is provided with detection openings 113 (FIG. 8) configured to expose the detection surfaces 112 of the registration sensors 102 and the density sensors 103 (FIG. 5, FIG. 6) to the intermediate transfer belt 7 formed therethrough. The sensor unit 100 includes ducts (sensor ducts) 105 configured to seal the registration sensors 102 and the density sensors 103 in the interior of the housing 110 and introduce air to the detection openings 113. The sensor unit 100 includes an openable-and-closable shutter member (protecting member, openable-and-closable member) 106 configured to protect the detection surfaces 112 of the registration sensors 102 and the density sensors 103 when the registration sensors 102 and the density sensors 103 do not operate. The sensor unit 100 includes a shutter drive unit 107 configured to drive the shutter member 106 to open and close. In addition, the sensor unit 100 includes an electric substrate 108 configured to process electric signals from the registration sensors 102, the density sensors 103, and the shutter drive unit 107.

As illustrated in FIG. 3 and FIG. 4, the housing 110 including the frame 101 and the sensor supporting plate 104 has a box shape elongated in the width direction of the intermediate transfer belt 7 (the direction substantially orthogonal to the direction of conveyance). The frame 101 forms a front side, a rear side, a left side, a right side, and an upper side surface of the housing 110, and the sensor supporting plate 104 forms a lower side surface. The sensor unit 100 is fixed to the apparatus body 9 by a positioning unit 109 provided on the frame 101 fits into a unit positioning unit (not illustrated) provided on the apparatus body 9. The sensor supporting plate 104 is mounted on the frame 101 so as to be slidable in the substantially perpendicular direction with respect to the intermediate transfer belt 7. The sensor supporting plate 104 is biased toward the intermediate transfer belt 7 by a pressure spring (not illustrated) as a biasing device provided in the interior of the housing 110. The sensor supporting plate 104 is provided with a sensor positioning portion 119 for maintaining a distance of the intermediate transfer belt 7 with respect to the registration sensors 102 and the density sensors 103 constant. The sensor positioning portion 119 abuts against an abutting portion 76 provided on the intermediate transfer belt unit 70. The abutting portion 76 is provided on a rotary shaft of the backup roller 74 arranged on the inner peripheral surface side of the intermediate transfer belt 7. The backup roller 74 restrains flapping of the intermediate transfer belt 7. Accordingly, the detection performances of the registration sensors 102 and the density sensors 103 are stabilized.

In this example, although the backup roller 74 is provided for the purpose of restraining the flapping of the intermediate transfer belt 7, this disclosure is not limited thereto. For example, a supporting member (backup member) having other given forms such as a supporting metal plate for restraining the flapping of the intermediate transfer belt 7.

As illustrated in FIG. 8, the detection surfaces 112 of the registration sensors 102 and the density sensors 103 mounted on the sensor supporting plate 104 face the surface of the intermediate transfer belt 7 through the detection openings 113 provided in the sensor supporting plate 104. Accordingly, the registration sensors 102 and the density sensors 103 are capable of detecting the color-correction patch and the density correction patch, which are objects to be detected on the surface of the intermediate transfer belt 7, respectively. Three of the registration sensors 102 are arranged in the width direction of the intermediate transfer belt 7. The amounts of misalignment of the respective colors are calculated on the basis of the results of detection of the color-correction patches of respective colors, namely, yellow, magenta, cyan, and black by the registration sensors 102. The amount of misalignment calculated here includes a misalignment of the writing positions of the respective colors in the direction of conveyance of the intermediate transfer belt 7, a misalignment of the writing position of the respective colors in the width direction of the intermediate transfer belt 7, a misalignment of inclination of the respective colors with respect to a reference direction, and a misalignment of magnification of respective colors. The calculated amounts of misalignment are processed by an image control controller of the control unit 200 and are fed back to an output image. Three of the density sensors 103 are arranged in the width direction of the intermediate transfer belt 7. The density sensors 103 detect the density correction patches of the respective colors, namely, yellow, magenta, cyan, and black, and amounts of density change of the respective colors are calculated on the basis of the results of detection. The calculated amounts of density change are processed by the density control controller of the control unit 200, and are fed back to the control of the image forming unit P. The number of the registration sensors 102 and the density sensors 103 are not limited to those in this example.

As illustrated in FIG. 5, each of the registration sensors 102 includes following elements as principal components. Each of the registration sensors 102 includes a sensor housing 114. The registration sensor 102 includes a light source (an LED light source in this example) 115, a lens 116 configured to collect reflection lights from the object to be detected, and a light-receiving portion (photo diode in this example) 117 configured to receive the collected light in the interior of the sensor housing 114. The registration sensor 102 also includes a substrate 118 on which the light source 115 and the light-receiving portion 117 are mounted. The registration sensor 102 includes a detection surface (cover glass) 112 provided so as to oppose the intermediate transfer belt 7 to be directed toward the object to be detected and formed of a glass plate as a dust-proof member. A distance between the detection surface 112 and the surface of the intermediate transfer belt 7 is set to approximately 5 mm. The configuration of the registration sensor 102 is not limited to that of this example.

As illustrated in FIG. 6, each of the density sensors 103 includes following elements as principal components. Elements having the same or corresponding functions as the registration sensor 102 are denoted by the same reference signs. Each of the density sensors 103 includes a sensor housing 114. The density sensor 103 includes a light source (an LED light source in this example) 115, and a light-receiving portion (photo diode in this example) 117 configured to receive reflected light from the object to be detected in the interior of the sensor housing 114. The density sensor 103 includes the substrate 118 on which the light source 115 and the light-receiving portion 117 are mounted. The density sensor 103 includes a detection surface (cover glass) 112 provided so as to oppose the intermediate transfer belt 7 to be directed toward the object to be detected and formed of a glass plate as a dust-proof member. A distance between the detection surface 112 and the surface of the intermediate transfer belt 7 is set to approximately 5 mm. The configuration of the density sensor 103 is not limited to that of this example.

In this example, an amount of misalignment of the color-correction patches of the respective colors is measured by the registration sensors 102 on the basis of a difference between an amount of light reflected from the intermediate transfer belt 7 and an amount of light reflected from the color-correction patch, and the amounts of correction of the writing positions of the respective colors are calculated. In this example, a difference between an amount of light reflected from a density reference member (described later) provided on the shutter member 106 and an amount of light reflected from the density correction patch is measured by the density sensors 103. Then, on the basis of the difference, the image density of the density correction patch of the respective colors is measured, and the amounts of correction of the image density s of the respective colors are calculated.

As illustrated in FIG. 3, the shutter member 106 is coupled to the shutter drive unit 107 via a follower 165 formed integrally with the shutter member 106 or coupled to the shutter member 106 (formed integrally in this example). The shutter member 106 is a substantially rectangular plate-shaped member elongated in the width direction of the intermediate transfer belt 7, and is mounted on the frame 101 so as to be slidable in the width direction of the intermediate transfer belt 7. The shutter member 106 is biased rearward along the width direction of the intermediate transfer belt 7 by a tension spring 166 (FIG. 10) as a biasing device. The shutter member 106 is opened and closed by a drive motor (shutter opening and closing cam drive motor) 171 and a drive cam (shutter opening and closing cam) 172 provided on the shutter drive unit 107. The shutter drive unit 107 will be described further in detail later.

The shutter member 106 is arranged between the housing 110 and the intermediate transfer belt 7. In other words, the shutter member 106 is arranged between the registration sensor 102 and the density sensors 103 exposed from the detection openings 113 and the intermediate transfer belt 7. The shutter member 106 is movable between an opened position at which the detection surfaces 112 of the registration sensors 102 and the density sensors 103 are exposed to the intermediate transfer belt 7 and a closed position at which the detection surfaces 112 are blocked with respect to the intermediate transfer belt 7. In this example, as will be descried in detail later, the shutter member 106 is brought into a closed position by being moved forward against a biasing force of the tension spring on the drive cam 172, and is brought into the opened position by being released from a pressure by the drive cam 172 and moved rearward. As illustrated in FIG. 7, the shutter member 106 includes an exposing portion 161 configured to expose the detection surfaces 112 of the registration sensors 102 and the density sensors 103 to the intermediate transfer belt 7 when being at the opened position. The shutter member 106 also includes a shielding portion 162 arranged between the detection surfaces 112 of the registration sensors 102 and the density sensors 103 and the intermediate transfer belt 7 when being at the closed position. When the shutter member 106 is at the opened position, the exposing portion 161 as an opening portion is arranged under the detection surfaces 112 so that the registration sensors 102 and the density sensors 103 are capable of detecting the object to be detected on the surface of the intermediate transfer belt 7. When the shutter member 106 is at the closed position, the detection surfaces 112 are covered with the shielding portion 162 so as to avoid adhesion of dirt such as toner to the registration sensors 102 and the density sensors 103. The shutter member 106 is provided with a density reference member (density reference plate) 163 for correcting the results of detection of the density sensors 103 so that the shutter member 106 is arranged under the detection surfaces 112 of the density sensors 103 when the shutter member 106 is at the closed position.

In this example, when the shutter member 106 is at the opened position, detection by all of the sensors 102 and 103 of the sensor unit 100 is enabled, and when the shutter member 106 is at the closed position, detection by all of the sensors 102 and 103 of the sensor unit 100 is disabled.

3. Shutter Drive Unit

Figure 9:
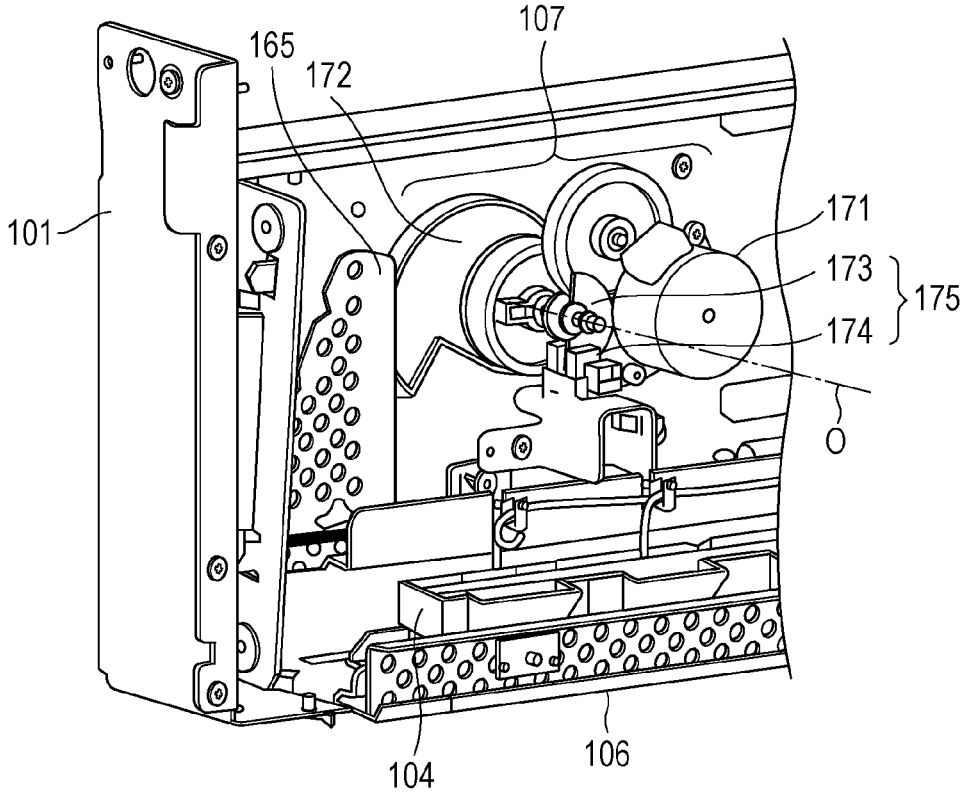
FIG. 9 is a perspective view illustrating a shutter drive unit.

A configuration of the shutter drive unit 107 will be described further in detail. FIG. 9 is a perspective view of the interior of the sensor unit 100 viewed from the right side of the image forming apparatus 10, in which a portion in the vicinity of the shutter drive unit 107 is illustrated further in detail. FIG. 10 to FIG. 13 are schematic drawings illustrating an action of the shutter drive unit 107.

As described above, the shutter drive unit 107 includes the drive motor 171, and the rotatable drive cam 172 configured to move the shutter member 106. The shutter member 106 is coupled to the shutter drive unit 107 via the follower 165, and is opened and closed by the drive motor 171 and the drive cam 172.

The shutter drive unit 107 includes a home position sensor 175 as a phase detection device configured to detect a phase (rotational position) of the drive cam 172. The home position sensor 175 includes a flag 173 fixed coaxially with the drive cam 172 and rotate in the same phase as the drive cam 172, and a photo-interrupter 174 configured to detect the flag 173. The phase of the drive cam 172 is detected by the home position sensor 175, and the control unit 200 controls the drive of the drive motor 171 on the basis of the result of detection thereof, so that the position of the shutter member 106 is controlled.

In this example, the shutter member 106 is capable of moving reciprocally along a fore-and-aft direction of the image forming apparatus 10. At this time, the direction of movement from the front to the rear of the shutter member 106 is determined as a first direction of movement, and the direction of movement opposite thereto is determined as a second direction of movement. In this example, the drive cam 172 is rotatable around a rotary axis O (FIG. 9) along a direction substantially orthogonal to a direction of movement of the shutter member 106 (substantially parallel to the surface of the shutter member 106). At this time, a clockwise direction of rotation, when viewing the drive cam 172 in the direction of a rotary axis from the right side of the image forming apparatus 10 (the near side of the paper plane of FIG. 10 to FIG. 13), is determined as a normal direction (a first direction of rotation), and a direction of rotation opposite thereto is determined as a reverse direction (a second direction of rotation).

Here, as described above, the toner flying from the surface of the intermediate transfer belt 7 may be adhered to and accumulated on the surface of the shutter member 106 arranged between the registration sensors 102 and the density sensor 103 and the intermediate transfer belt 7. There may be a case where a problem such that the accumulated toner drops on an image formed on the intermediate transfer belt 7, which may result in dirty image such as "dripping".

Figure 10:
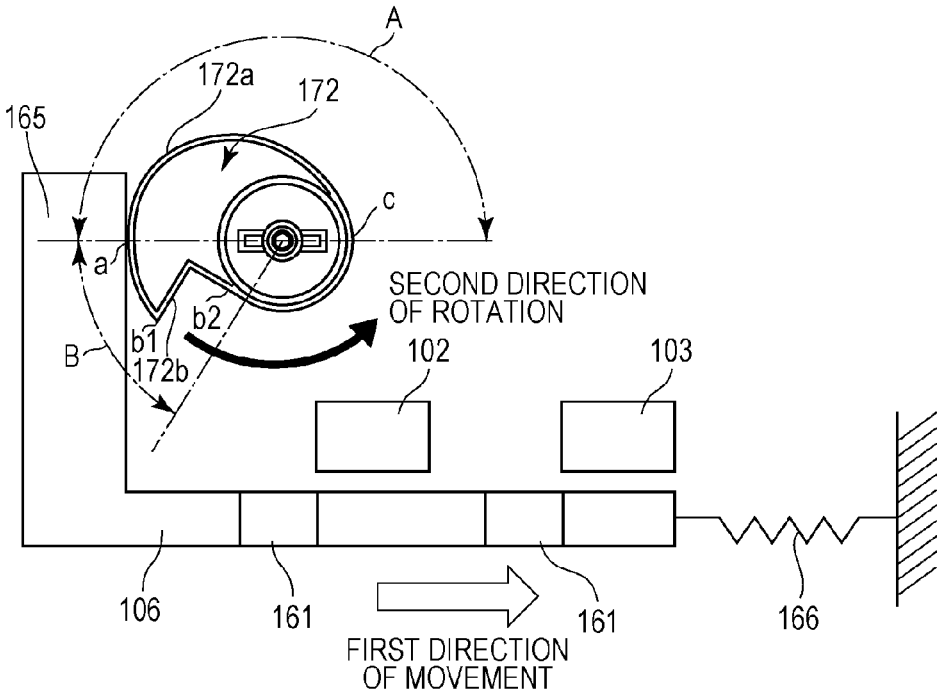
FIG. 10 is a schematic drawing illustrating movements of a drive cam and the shutter member.

Therefore, in this example, as described below in detail, the control unit 200 may be configured to selectively execute a first mode and a second mode as follows. In other words, in the first mode, the drive cam 172 is rotated within a range of a first phase to open and close the shutter member 106. In the second mode, the drive cam 172 is rotated while going at least through a range of a second phase different from the first phase to apply vibrations to the shutter member 106. As illustrated in FIG. 10, the drive cam 172 has a first area (opening and closing area) A for acting on and moving the shutter member 106 when the drive cam rotates within the range of the first phase. The drive cam 172 has a second area (vibration area) B for acting on and giving an impact on the shutter member 106 when the drive cam 172 rotates within the range of the second phase. In this example, an opening and closing portion 172*a*, which is a cam surface increasing or decreasing in distance from a center of rotation of the drive cam 172 continuously in a circumferential direction is provided in the first area A. In this example, a vibration applying portion 172*b* as a step, which is a vibration applying device configured to apply vibrations in the shutter member 106 is provided in the second area B.

The opening and closing action of the shutter member 106 in the first mode (first opening-and-closing mode) will be described.

Figure 11:
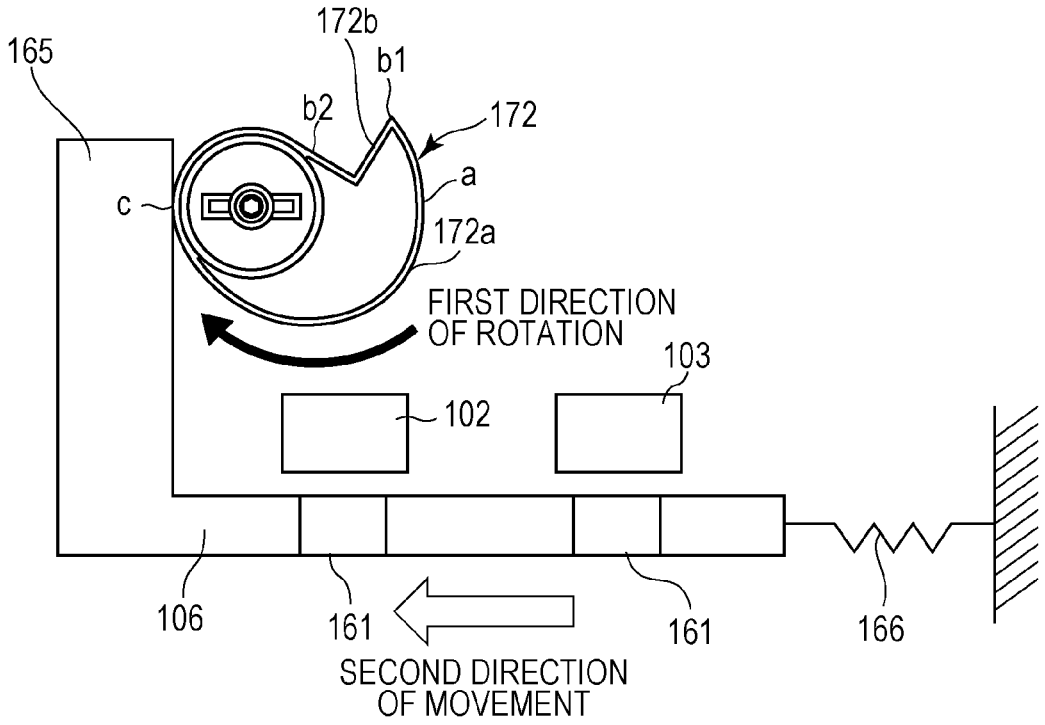
FIG. 11 is a schematic drawing illustrating movements of the drive cam and the shutter member.

FIG. 10 illustrates a state in which the shutter member 106 is at the closed position (a state of having moved to a terminal of the second direction of movement). At this time, the follower 165 is in a state of abutting against a first end a of the opening and closing portion 172*a*, which is substantially the largest diameter portion of the drive cam 172. In contrast, FIG. 11 illustrates a state in which the shutter member 106 is at the opened position (the state of having moved to a terminal in the first direction of movement). At this time, the follower 165 is in the state of abutting against a second end c of the opening and closing portion 172*a*, which is substantially the smallest diameter portion of the drive cam 172.

In the case where the shutter member 106 is changed from the closed state to the opened state in the first mode, the drive cam 172 is rotated from a state in which the shutter member 106 is at the closed position in the reverse direction (second direction of rotation) as illustrated in FIG. 10. Accordingly, the shutter member 106 is moved in the first direction of movement to a state in which the shutter member 106 is at the opened position as illustrated in FIG. 11. In other words, a state in which the first end a of the opening and closing portion 172*a*, which is substantially the largest diameter portion of the drive cam 172, is in a state of abutting against the follower 165 is transferred to a state in which the second end c of the opening and closing portion 172*a*, which is substantially the smallest diameter portion of the drive cam 172, is in a state of abutting against the follower 165. Accordingly, the shutter member 106 is changed from the closed state to the opened state.

In the case of changing the state of the shutter member 106 from the opened state to the closed state in the first mode, the drive cam 172 is rotated in the normal direction (first direction of rotation) from a state in which the shutter member 106 is at the opened position as illustrated in FIG. 11. Accordingly, the shutter member 106 is moved in the second direction of movement, and is transferred to the state in which the shutter member 106 is at the closed position as illustrated in FIG. 10. In other words, a state in which the second end c of the opening and closing portion 172*a*, which is substantially the smallest diameter portion of the drive cam 172, is in a state of abutting against the follower 165 is transferred to a state in which the first end a of the opening and closing portion 172*a*, which is substantially the largest diameter portion of the drive cam 172, is in a state of abutting against the follower 165. Accordingly, the shutter member 106 is changed from the opened state to the closed state.

In this manner, in the first mode, the drive cam 172 performs the opening-and-closing action of the shutter member 106 by repeating the rotation by a substantially half a turn in the normal and reverse direction within a range of the first phase between the state illustrated in FIG. 10 and the state illustrated in FIG. 11. Detailed modes of the direction of rotation and a rotational angle of the drive cam 172 are not limited to those described in this example. In this embodiment, although the shutter member 106 and the follower 165 are integrally formed, the invention is not limited thereto, and these members may be provided separately and coupled in operation.

The timing of the opening and closing action of the shutter member 106 in the first mode will be described.

In this example, the control unit 200 controls the opened-and-closed position of the shutter member 106 on the basis of the result of detection of the home position sensor 175. At this time, the control unit 200 controls so as to open the shutter member 106 at timing of detecting patches with the sensors 102 and 103. In other words, the control unit 200 brings the shutter member 106 to the opened position immediately before the patches formed on the intermediate transfer belt 7 pass through a portion opposing the sensors 102 and 103, and brings the shutter member 106 to the closed position immediately after the patches have passed through the portions opposing the sensors 102 and 103. For example, control may be made in such a manner that the shutter member 106 is brought to the opened position immediately before a series of patches detected continuously in one period are conveyed to the portions opposing the sensors, and the shutter member 106 is brought to the closed position immediately after the series of patches have passed through the portions opposed to the sensors. In this example, a period when the shutter member 106 is opened is set to approximately 0.3 seconds. Timing or a period when the shutter member 106 is opened is not limited to those in this example.

A vibrating action with respect to the shutter member 106 in the second mode (second opening-and-closing mode) will be described.

Figure 12:
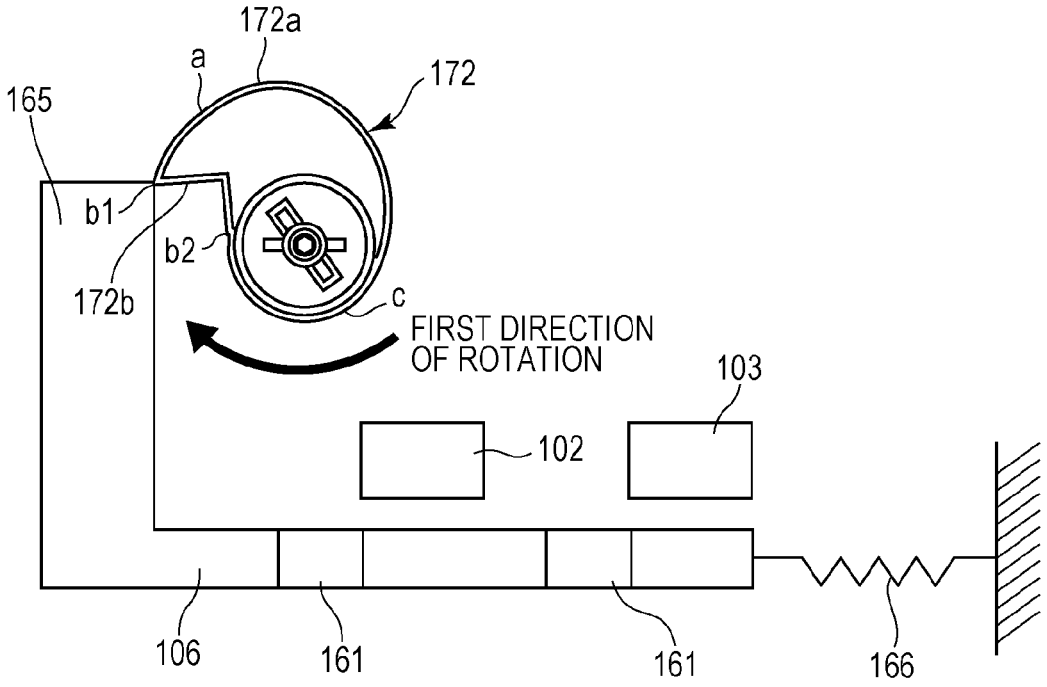
FIG. 12 is a schematic drawing illustrating movements of the drive cam and the shutter member.

FIG. 12 illustrates a state in which the drive cam 172 is rotated further in the normal direction (first direction of rotation) from a state in which the shutter member 106 is at the closed position illustrated in FIG. 10. At this time, the drive cam 172 goes out a range of the first phase and enters a range of the second phase, and is brought into a state in which the follower 165 abuts immediately before the vibration applying portion 172*b*, which is a step provided in the second area B of the drive cam 172. Since the position immediately before the vibration applying portion 172*b* of the drive cam 172 is substantially the largest diameter portion, the shutter member 106 maintains a state of being at the closed position.

Figure 13:
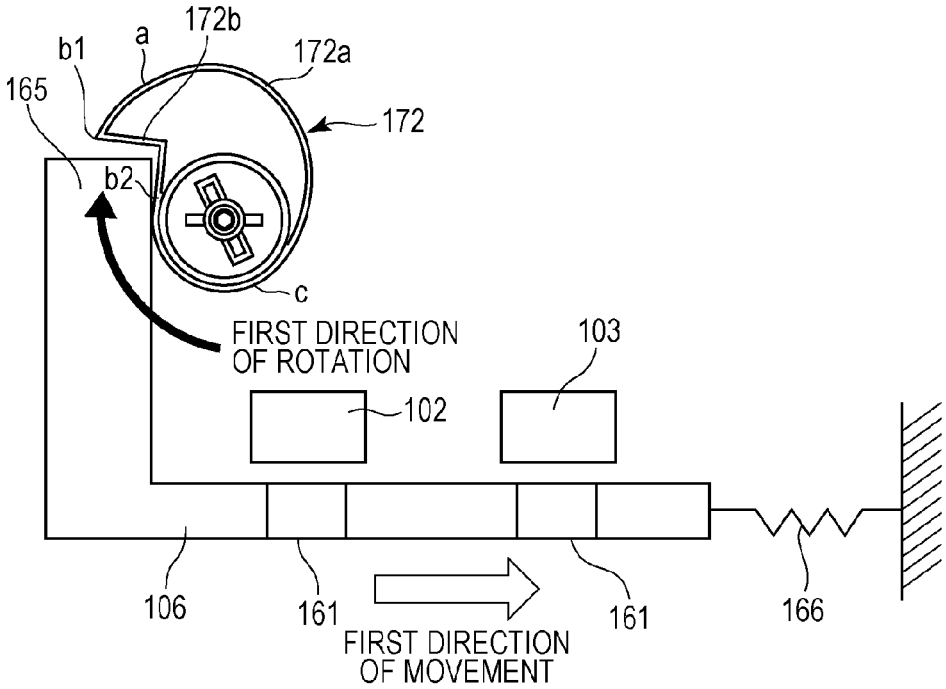
FIG. 13 is a schematic drawing illustrating movements of the drive cam and the shutter member.

FIG. 13 illustrates a state in which the drive cam 172 is rotated further in the normal direction (first direction of rotation) from a state illustrated in FIG. 12. At this time, an abutting position of the drive cam 172 with respect to the follower 165 is abruptly transferred from an apex b1, which is substantially the largest diameter portion of the drive cam 172 to a bottom b2, which is substantially the smallest diameter portion. Here, the shutter member 106 is biased by the tension spring 166 in the first direction of movement. Therefore, by the abutting position of the drive cam 172 with respect to the follower 165 transferring as described above, the shutter member 106 moves vigorously in the first direction of movement and the follower 165 hits the bottom b2 of the vibration applying portion 172*b* of the drive cam 172 with an impact force. Accordingly, vibrations are applied in the shutter member 106. Since the bottom b2 of the vibration applying portion 172*b* of the drive cam 172 of the drive cam 172 is substantially the smallest diameter portion, the shutter member 106 is a state of being at the opened position. After the application of vibrations in the shutter member 106, the drive cam 172 is rotated further in the normal direction (first direction of rotation). Accordingly, the second end c and the first end a of the opening and closing portion 172*a* are brought into abutment with the follower 165 in sequence, and the shutter member 106 is transferred to the state of being at the closed position (FIG. 10).

In this manner, in the second mode, the vibration may be applied in the shutter member 106. A configuration in which the vibration applying portion 172*b* is caused to pass through the abutment position with respect to the follower 165 once and apply vibrations in the shutter member 106 once while the vibrating action by the second mode is performed once, or the vibration applying portion 172*b* passes through the abutting position by a plurality of times to apply vibrations several times repeatedly is also applicable. Suitable setting may be achieved so as to shake off the adhered substance such as the toner adhered to the shutter member 106.

When performing the correction of color-registration or the correction of density, by causing the shutter member 106 to act in the first mode, shaking off of the toner adhered to and accumulated on the surface of the shutter member 106 is restrained. In contrast, by causing the shutter member 106 in the second mode, vibrations are applied in the shutter member 106, and hence the toner adhered to and accumulated on the shutter member 106 can be shaken off. The toner shaken off the shutter member 106 falls on the intermediate transfer belt 7.

The detailed shape of the vibration applying portion 172*b* such as the height of the step may be set as needed so that an impact load which can shake off the adhered substances such as toner adhered to the shutter member 106 can be applied to the shutter member 106 sufficiently. The adhered substance adhered to the shutter member 106 is not limited to the toner, and includes arbitrary substances which may be flown or suspended in the interior of the apparatus body 9 and adhered to the shutter member 106 such as an agent added to the toner, paper powder (mainly powder body or particle substances). In this example, the follower 165 is displaced so as to drop from the apex b1 to the bottom b2 without following the peripheral surface of the drive cam 172 in the vibration applying portion 172*b*. However, a configuration in which the vibration applying portion 172*b* is formed by a cam surface the distance of which from the center of rotation of the drive cam 172 is decreased steeply to an extent which can exert vibrations sufficiently in the shutter member 106 so that the follower 165 is displaced so as to follow thereto is also applicable. In this case, the vibration applying portion 172*b* is configured so that the shutter member 106 is typically configured to be displaced at a speed of displacement faster than a speed at the opening and closing portion 172*a*, and a sufficient impact load is applied to the shutter member 106 at a terminal of the displacement. In this example, the vibration applying portion 172*b* is formed by a single step. However, a plurality of steps may be provided.

The timing of the vibrating action of the shutter member 106 in the second mode will be described.

As described above, the toner flying from the surface of the intermediate transfer belt 7 and adhered to the shutter member 106 is accumulated gradually by the repeated image formation. Therefore, after the toner has shaken off the shutter member 106 by executing the second mode once, a problem such as "dripping" cannot be generated even without executing the second mode for a certain period.

Therefore, in this example, the control unit 200 as the control device causes the drive cam 172 as the vibration applying device to execute the vibrating action which applies vibrations in the shutter member 106 on the basis of the image formation history information.

When the shutter member 106 is operated in the second mode as described above, the toner drops onto the intermediate transfer belt 7 from the shutter member 106. Therefore, when executing the second mode, it is necessary that the output image to be recorded on the transfer material S and output or the reference images (such as the color-correction patch and the density correction patch) are not present on the intermediate transfer belt 7 opposing the shutter member 106. In other words, the second mode is determined whether or not to be executed on the basis of the image formation history information, and is executed when the image to be conveyed by the image bearing member is not present on the portions opposing the sensors. In this example, the second mode is executed at a predetermined timing when the patches are not conveyed to the portion opposing the shutter member 106 at the time of non-image forming period other than an image forming period when the output image is formed. Examples of the non-image forming period include the following. There is a pre-multi-rotation in which a predetermined preparatory action to be performed when a power of the image forming apparatus is turned ON or when the mode is restored from a sleep mode. There is a pre-rotation period in which a predetermined preparatory action is executed from an input of a signal of a job (a series of image forming actions with respect to the single or a plurality of transfer materials on the basis of one start instruction) until actual writing out of the image. There is also an inter-sheet period which corresponds to a portion between the transfer material and the transfer material in the job in which image formation is performed continuously with respect to the plurality of transfer materials. There is also a post-rotation period in which a predetermined arrangement action (preparatory action) is executed after the termination of the job. There is also a waiting period of writing an input of a signal of a job.

In this example, the number of formed images (number of images formed continuously) of the job for forming an image continuously and the accumulated number of formed images after the previous execution of the second mode are used as the image formation history information. More specifically, in this example, when the number of images formed continuously reaches 6,500 images, or when the accumulated number of formed images reaches 5,500 images, the second mode is executed in a state in which the intermediate transfer belt 7 is rotated during the rearward rotation after the termination of the job.

Figure 14:
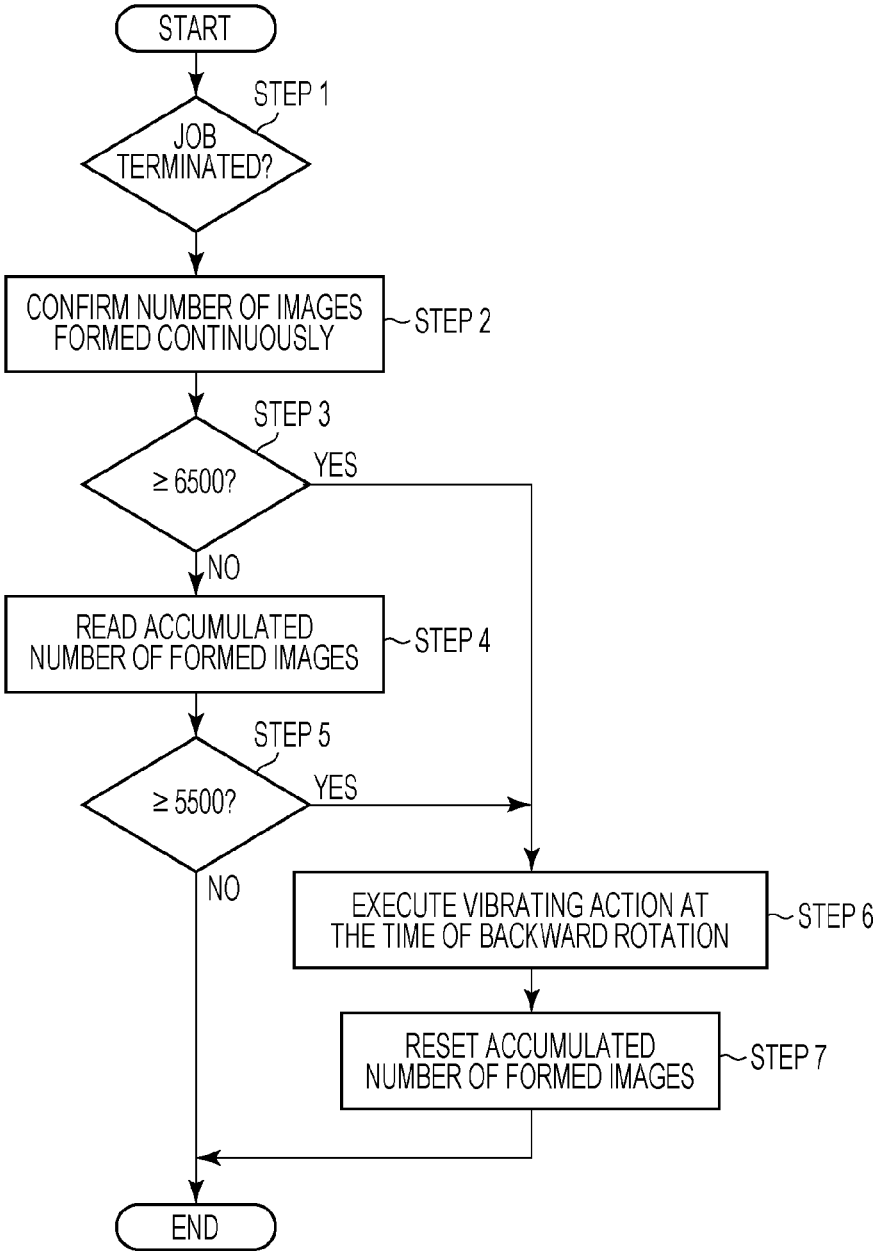
FIG. 14 is a flowchart illustrating a flow of a process configured to determine whether or not a vibrating action is to be executed.

FIG. 14 illustrates a schematic flow of the process for determining whether or not the vibrating action is to be executed with respect to the shutter member 106 in the second mode of this example. When a job is terminated (Step 1), the control unit 200 confirms the number of images formed continuously of the job in question from the information of the job memorized in a memory 202 (Step 2). Subsequently, the control unit 200 determines whether or not the number of images formed continuously reaches or exceeds 6,500 images (Step 3). Subsequently, when it is determined that the number of images formed continuously reaches or exceeds 6,500 images in Step 3 ("Yes" in Step 3), the control unit 200 causes the vibrating action with respect to the shutter member 106 in the second mode to be executed during the rearward rotation (Step 6). Subsequently, the accumulated number of formed images memorized in the counter 203 is cleared to zero (Step 7) and the process is terminated.

In contrast, when it is determined that the number of images formed continuously is smaller than 6,500 images in Step 3 ("No" in Step 3), the control unit 200 reads the accumulated number of formed images after the previous execution of the second mode from the counter 203 (Step 4). Subsequently, the control unit 200 determines whether or not the accumulated number of formed images reaches or exceeds 5,500 images (Step 5). Subsequently, when it is determined that accumulated number of formed images reaches or exceeds 5, 500 images in Step 5 ("Yes" in Step 5), the control unit 200 causes the vibrating action with respect to the shutter member 106 in the second mode to be executed during the rearward rotation (Step 6). Subsequently, the accumulated number of formed images memorized in the counter 203 is cleared to zero (Step 7) and the process is terminated. Subsequently, when it is determined that accumulated number of formed images is smaller than 5, 500 images in Step 5 ("No" in Step 5), the control unit 200 terminates the process without causing the vibrating action with respect to the shutter member 106 in the second mode to be executed during the rearward rotation.

A predetermined value (threshold value) to be compared with the number of images formed continuously and the accumulated number of formed images as the image formation history information is not limited to those of this example, and may be set as needed in accordance with adhered substances such as the toner to the shutter member 106 or easiness of accumulation. Also, only one of the number of images formed continuously and the accumulated number of formed images may be used as the image formation history information. In other words, the number of images formed continuously may be used as the image formation history information and the vibrating action may be executed when the value reaches or exceeds the predetermined value. Alternately, the information on the accumulated number of images formed after the previous execution of the vibrating action may be used as the image formation history information and the vibrating action may be executed when the value reaches or exceeds the predetermined value. Here, the information on the number of images formed continuously or the information on the accumulated number of formed images may be the number of images itself, and may be information having a correlation with the number of images. Examples of the information having a correlation with the number of images include a number of rotations and a period of rotation of a rotating member that rotates when forming the image, for example. For example, the continuous number of rotations and the accumulated number of rotations of the rotating member may be memorized and the second mode may be executed when the value reaches or exceeds the predetermined value. The image formation history information is not limited to the number of images formed continuously and the accumulated number of formed images. For example, an amount of toner adhered and accumulated on the shutter member 106 varies in accordance with the toner amount of the image formed on the intermediate transfer belt 7 and passing through the portion opposing the shutter member 106. Therefore, the information on the toner amount used for the image formation may be used as the image formation history information and the vibrating action may be executed when the value reaches or exceeds the predetermined value. Here, the information of the toner amount may be the toner amount itself, and may be information having a correlation with the toner amount. Examples of the information having a correlation with the toner amount includes information on density of an image to be formed, for example. For example, a product value of the information on the density s of the respective pixels may be memorized and the second mode may be executed when the value reaches or exceeds the predetermined value.

Preferably, the intermediate transfer belt 7 is rotating at a timing when the vibrating action with respect to the shutter member 106 is executed in the second mode. In other words, the second mode is preferably executed while the image bearing member is moving. In other words, the toner dropped on the intermediate transfer belt 7 from the shutter member 106 because of the application of vibrations may be collected by the belt cleaner 75 located downstream of the portion opposing the sensor unit 100 in the direction of conveyance of the intermediate transfer belt 7. Alternatively, in the case where a secondary transfer member cleaner (not illustrated) configured to clean the secondary transfer roller 8 is provided, the toner transferred from the intermediate transfer belt 7 to the secondary transfer roller 8 may be collected by the secondary transfer member cleaner. At this time, by executing the vibrating action with respect to the shutter member 106 in the second mode during the rotation of the intermediate transfer belt 7, the toner may splashed to avoid a large amount of the toner from dropping at one point in the direction of conveyance of the intermediate transfer belt 7 to reduce a load of collection applied to the cleaner. However, this disclosure is not limited to this configuration, and the vibrating action with respect to the shutter member 106 in the second mode may be executed at a timing when the intermediate transfer belt 7 is not rotating if desired.

As described thus far, according to this example, the problem of dirty images caused by adhered substance such as the toner adhered to and accumulated on the openable-and-closable shutter member 106 configured to protect the sensors 102 and 103 dripping accidentally thereon is restrained. In addition, unnecessary execution of the vibrating action with respect to the shutter member 106 in the second mode is restrained, so that unnecessary elongation of the process such as the rearward rotation, for example, is restrained.

Example 2

Another example of this disclosure will be described. Basic configurations and actions of the image forming apparatus of this example is the same as those of Example 1. Therefore, elements having the same or corresponding functions or configurations are denoted by the same reference sign as those of Example 1, and detailed description thereof is omitted.

Figure 15:
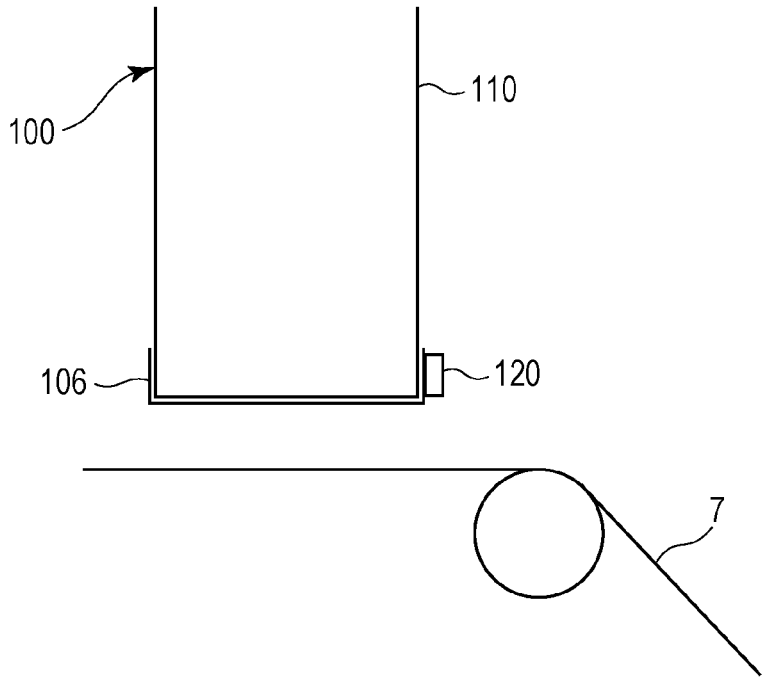
FIG. 15 is a schematic side view in the vicinity of the sensor unit illustrating another example of a vibration device.

FIG. 15 is a schematic side view illustrating a portion in the vicinity of the sensor unit 100 of this example. In this example, the image forming apparatus 10 includes an ultrasonic wave vibration generating apparatus 120 as the vibration applying device configured to vibrate the shutter member 106. Configurations configured to generate ultrasonic vibrations by using a piezoelectric element or a magnetostrictive element may be used as the ultrasonic wave vibration generating apparatus 120 arbitrarily. However, the piezoelectric element is preferable in terms of compactness, low cost, and reliability. In this example, the ultrasonic wave vibration generating apparatus 120 generating the ultrasonic vibration by the piezoelectric element is used.

The toner adhered to and accumulated on the shutter member 106 drops onto the intermediate transfer belt 7 by the vibrations applied in the shutter member 106 by the ultrasonic wave vibration generating apparatus 120. At this time, the ultrasonic vibration to be generated by the ultrasonic wave vibration generating apparatus 120 by using the piezoelectric element preferably includes the same number of vibrations as an eigen frequency of the toner. The term eigen frequency is a specific number of vibrations of a substance which generates a resonance phenomenon when vibrations are applied in the substance. The eigen frequency f of the toner is determined by a particle diameter of the toner, and is expressed by the following expression, $f=V_0/2\lambda$ ($\lambda$: particle diameter of toner, $V_0$: acoustic velocity).

Here, $f=2.8\times10^7$ Hz is satisfied where the particle diameter of the toner is 6 μm and the acoustic velocity is 340 m/s. However, since the eigen frequency varies slightly depending on the influence of the temperature and the moisture, the number of vibrations of the ultrasonic vibration generated by the ultrasonic wave vibration generating apparatus 120 is not limited to the same value as the above-described numerical value, which is the eigen frequency of the toner. The same effects and advantages are expected as long as the number of vibrations of the ultrasonic vibration to be generated by the ultrasonic wave vibration generating apparatus 120 is within an error range of ±20% toner with respect to the eigen frequency of the tone. Here, it is assumed that the number of vibrations is substantially the same number of vibrations as the eigen frequency of the toner including the number of vibrations within the error range.

Generation of the ultrasonic vibration during a predetermined period may be performed once in one vibrating action or may be repeated by a plurality of number of times. The period and the number of times of generating the ultrasonic vibration by the ultrasonic wave vibration generating apparatus 120 in one vibrating action may be set as needed so that the adhered substances such as the toner adhered to the shutter member 106 can be shaken off sufficiently.

In this example, a control member 200 causes the ultrasonic wave vibration generating apparatus 120 to execute the vibrating action which applies vibrations in the shutter member 106 at a predetermined timing. The timing of execution of the vibrating action with respect to the shutter member 106 of this example is the same as that of Example 1. In other words, when the image formation history information matches predetermined conditions, the vibrating action with respect to the shutter member 106 is executed at a timing when the intermediate transfer belt 7 is rotated during the rearward rotation and the patches are not conveyed to the portions opposing the shutter member 106.

In this example, the drive cam 172 used here for opening and closing the shutter member 106 does not have any step.

According to this example, the same effects and advantages as Example 1 are obtained, and the configuration that applies the vibrations in the shutter member 106 may be achieved relatively easily.

Example 3

Another example of this disclosure will be described. Basic configurations and actions of the image forming apparatus of this example is the same as those of Example 1. Therefore, elements having the same or corresponding functions or configurations are denoted by the same reference sign as those of Example 1, and detailed description thereof is omitted.

Figure 16A:
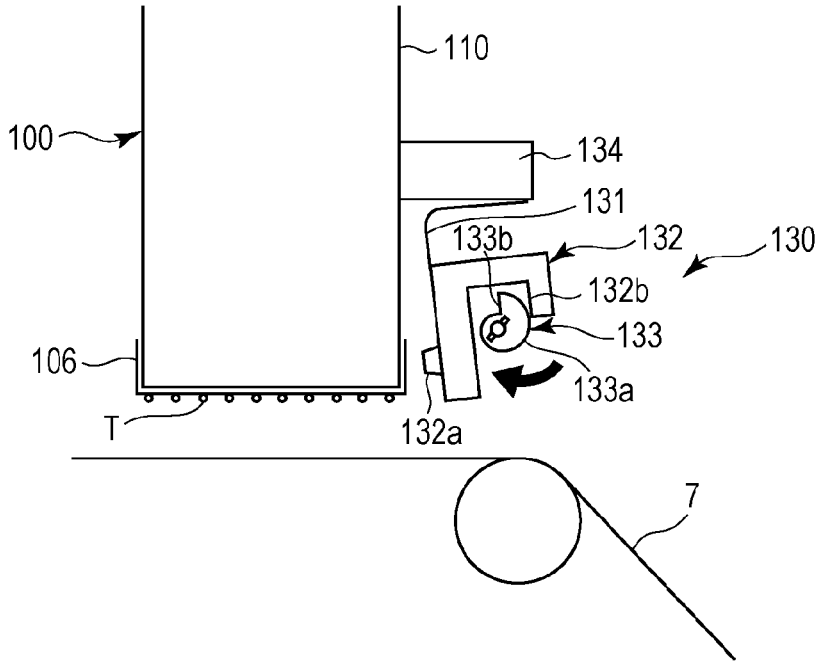
FIGS. 16A and 16B are schematic side views of a portion in the vicinity of the sensor unit illustrating another example of the vibration device.
Figure 16B:
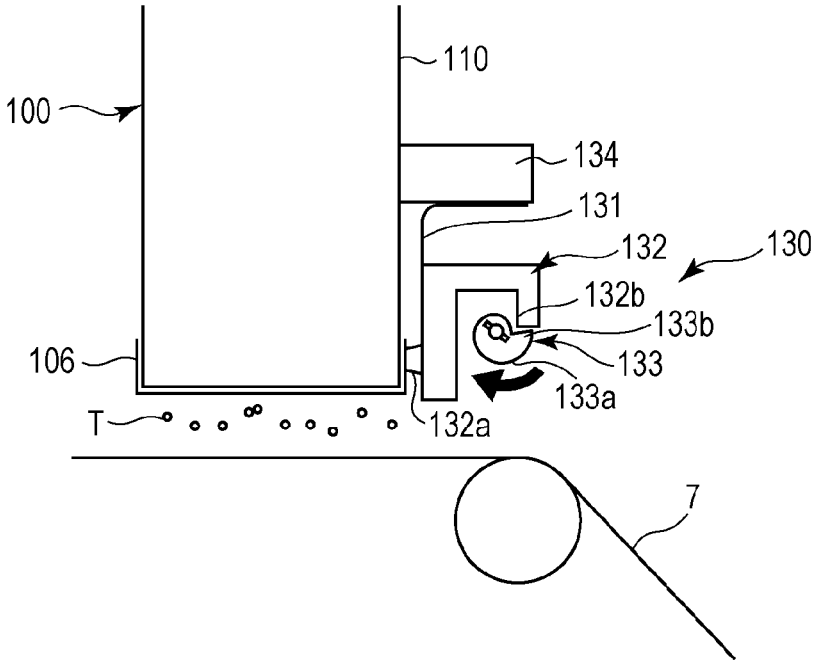

FIGS. 16A and 16B are schematic side views illustrating a portion in the vicinity of the sensor unit 100 of this example. In this example, an image forming apparatus 100 includes a hitting apparatus 130 configured to apply vibrations in the shutter member 106. FIG. 16A illustrates a state in which the vibrating action by the hitting apparatus 130 is not executed, and FIG. 16B illustrates a state in which the vibrating action by the hitting apparatus 130 is being executed.

The hitting apparatus 130 includes a metallic leaf spring 131 as a biasing device, a colliding member 132 configured to apply vibrations in the shutter member 106 by colliding therewith as a vibration applying device configured to apply vibrations in the shutter member 106, and a colliding member drive cam (stepped cam) 133. The colliding member drive cam 133 has the same cam shape as the drive cam 172 of the shutter drive unit 107 described in Example 1. In other words, the colliding member drive cam 133 includes a cam surface 133*a* configured to be gradually increased or gradually decreased in distance with respect to the center of rotation continuously in the circumferential direction between substantially the largest diameter portion and the substantially the smallest diameter portion, and a step 133*b* configured to reduce in distance abruptly from the center of rotation. The colliding member drive cam 133 is rotatable around a rotary axis of the sensor unit 100 extending substantially parallel to a longitudinal direction of the housing 110. The colliding member drive cam 133 is driven to rotate around a direction indicated by an arrow in the drawings (clockwise) at a predetermined timing by a colliding member drive motor (not illustrated).

The leaf spring 131 is fixed to the colliding member 132 by a screw (not illustrated) as a fixing device at one of ends side to be integrated with the colliding member 132. The leaf spring 131 is fixed at the other end side thereof by a screw (not illustrated) as the fixing device to a mounting wall 134 provided so as to project from a right side surface of the housing 110 of the sensor unit 100 in a substantially perpendicular direction. Accordingly, the colliding member 132 is pivotably supported by the mounting wall 134 via the leaf spring 131. The colliding member 132 includes a colliding portion 132*a* configured to collide with the shutter member 106, and a follower portion 132*b* with which the colliding member drive cam 133 comes into abutment. A biasing force acts by the leaf spring 131 on the colliding member 132 integrated with the leaf spring 131 leftward in the drawing toward the right side surface of the housing 110 of the sensor unit 100.

In the state illustrated in FIG. 16A, the colliding member drive cam 133 is in abutment with the follower portion 132*b* of the colliding member 132 at substantially the largest diameter portion. Accordingly, the colliding member 132 is moved against the biasing force of the leaf spring 131 in a reverse direction from the direction of the biasing force, and the colliding portion 132*a* is held at a position apart from the shutter member 106. When the vibrating action is not executed, the hitting apparatus 130 is maintained in this state.

When applying vibrations in the shutter member 106 by the hitting apparatus 130, the colliding member drive cam 133 is rotated from the state illustrated in FIG. 16A counterclockwise in the drawing. Accordingly, as illustrated in FIG. 16B, an abutting position of the colliding member drive cam 133 with respect to the follower portion 132*b* of the colliding member 132 is abruptly transferred from an apex of the step which is substantially the largest diameter portion of the colliding member drive cam 133 to the bottom of the step, which is substantially the smallest diameter portion of the colliding member drive cam 133. In this case, the colliding portion 132*a* of the colliding member 132 abuts against the shutter member 106 with an impact force by the biasing force of the leaf spring 131, and vibrations are applied in the shutter member 106. Accordingly, toner T adhered to and accumulated on the shutter member 106 drops onto the intermediate transfer belt 7 from the surface of the shutter member 106.

Causing the colliding member 132 to collide with the shutter member 106 may be performed once in one vibrating action or may be repeated by a plurality of number of times. Suitable setting may be achieved so as to shake off the adhered substance such as the toner adhered to the shutter member 106.

In this example, a control member 200 causes the hitting apparatus 130 to execute the vibrating action which applies vibrations in the shutter member 106 at a predetermined timing. The timing of execution of the vibration applying action with respect to the shutter member 106 of this example is the same as that of Example 1. In other words, when the image formation history information matches predetermined conditions, the vibrating action with respect to the shutter member 106 is executed at a timing when the intermediate transfer belt 7 is rotated during the rearward rotation and the patches are not conveyed to the portions opposing the shutter member 106.

In this example, the drive cam 172 used here for opening and closing the shutter member 106 does not have any step.

With the configuration of this example as well, the same effects and advantages as Example 1 are obtained. According to this example, the case where the vibration applying device cannot be integrated in the interior of the sensor unit 100 as in Example 1 is also accommodated. Other Examples Although this disclosure has been described in conjunction with detailed examples, this disclosure is not limited to the examples described thus far.

For example, in the above-described examples, the shutter member is changed from the closed position to the opened position by being moved in a biasing direction by the tension spring. However, this disclosure is not limited thereto. With the movement of this mode, the action of opening the shutter member may be performed at a relatively high speed. However, the relationship between the direction of movement and the opened-and-closed position of the shutter member is not limited to those of the examples described above, but may be opposite from the examples described above.

In the examples described above, the case where the image bearing member is the intermediate transfer member has been described. However, this disclosure is not limited thereto. For example, as is known by those skilled in the art, there is an image forming apparatus of a direct transfer system having a transfer material bearing member as the image bearing member instead of the intermediate transfer member of the examples described above, and configured to form an image by transferring the toner image on the transfer material borne by the transfer material bearing member. As the transfer material bearing member, for example, a transfer material bearing belt which is the same as the intermediate transfer belt in the above-described examples is used. In the image forming apparatus of this configuration as well, a reference image (toner image for adjustment such as the color-correction patch and the density correction patch) is formed on the transfer material bearing member or on the transfer material born by the transfer material bearing member, and the reference image is detected by the sensors to perform control of correcting the color or image density. Therefore, by applying this disclosure to the sensor unit of the image forming apparatus in this configuration, the same effects and advantages as those in the examples described above are achieved. In addition, the image bearing member may be of a drum-shaped or of an endless belt-shaped photosensitive member, and the same effects and advantages as those in the examples described above are achieved by applying this discloser to the sensor unit configured to detect the reference image formed thereon (the toner image for adjustment such as the density correction patch).

In the examples described above, the sensors are the optical sensors. However, this disclosure is not limited thereto, and a given sensor may be employed as long as the sensor is arranged so as to oppose the moving image bearing member and is capable of detecting the state of the object to be detected on the image bearing member. For example, in the case where the image bearing member is the photosensitive member, a potential sensor configured to detect a potential of a surface of the photosensitive member as the state on the photosensitive member may be employed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-074930, filed Mar. 31, 2014 which is hereby incorporated by reference herein in its entirety.

What is claimed is:

1. An image forming apparatus comprising:

a movable image bearing member configured to bear a toner image to be transferred to a recording material;

a mode executing portion configured to execute a test mode, a test toner image being formed on the image bearing member in the test mode;

a sensor arranged above the image bearing member, a sensing surface of the sensor opposing, the image bearing member;

a shutter member arranged between the sensor and the image bearing member and configured to be movable between an opened position for exposing the sensor to the image bearing member and a closed position for blocking the sensor with respect to the image bearing member;

a colliding mechanism, including a colliding portion, configured to execute an impact action to apply an impact to the shutter member by causing the shutter member and the colliding portion which are away from each other to collide; and an executing portion configured to execute the impact action when the image bearing member bears neither the toner image nor the test toner image at a portion opposing the sensor.

2. The image forming apparatus according to claim 1, wherein the executing portion executes the impact action when information relating to a number of images formed continuously reaches or exceeds a predetermined value.

3. The image forming apparatus according to claim 1, wherein the executing portion executes the impact action when information relating to an accumulated number of formed images after a previous execution of the impact action reaches or exceeds a predetermined value.

4. The image forming apparatus according to claim 1, wherein the executing portion executes the impact action when information relating to a toner amount used for image formation reaches or exceeds a predetermined value.

5. The image forming apparatus according to claim 1, the colliding mechanism further comprising:

An urging member configured to urge at least one of the colliding portion and the shutter to reduce the distance between the colliding portion and the shutter.

6. The image forming apparatus according to claim 5, wherein the colliding mechanism including a rotatable cam, a part of the rotatable cam including the colliding portion, a surface of the cam changing in a distance from a center of rotation in a step shape in a circumferential direction.

7. The image forming apparatus according to claim 1, further comprising a cleaning member configured to clean toner on a surface of the image bearing member, wherein the executing portion executes the impact action when the image bearing member is moving.

8. The image forming apparatus according to claim 1, wherein the image bearing member is an endless belt wound around a plurality of supporting rollers under a tension.

9. The image forming apparatus according to claim 1, wherein the sensor is arranged at a position opposing one of the plurality of the supporting rollers with the image bearing member interposed therebetween.

10. The image forming apparatus according to claim 1, wherein the sensor includes a light-receiving portion configured to receive reflecting light from a light source and the image bearing member.

11. The image forming apparatus according to claim 6, wherein the rotatable cam used for opening and closing the shutter member.

* * * * *